US005114496A

United States Patent [19]

Bordunov et al.

[11] Patent Number: 5,114,496

[45] Date of Patent: May 19, 1992

[54] METHOD OF CLEANING WORKPIECES AND AN APPARATUS FOR CARRYING OUT THE METHOD

[76] Inventors: Vladimir V. Bordunov, prospekt Akademichesky, 11, kv. 25; Leonid N. Karmadonov, ulitsa Ust-Kerepit, 104, kv. 1; Jury M. Ospischev, pereulok Mirny, 17, kv. 1; Vladimir A. Fedjunin, ulitsa Koshurnikova, 7, kv. 60; Sergei P. Zhuravkov, ulitsa 30 let Pobedy, 3, komnata 712; Evgeny A. Cherepenko, ulitsa Lazo, 20, kv. 57, all of Tomsk; Anatoly B. Sviridov, Krasny prospekt, 87/2, kv. 62, Novosibirsk; Lev S. Verkhorubov, ulitsa Udmurtskaya, 255, kv. 184; Arkady T. Mikhailov, ulitsa Dzerzhinskaya, 61, kv. 29, both of Izhevsk; Jury L. Bakhmutov, ulitsa Glazovskaya, 3, kv. 8; Valery S. Shaidurov, ulitsa Kirovogradskaya, 75, kv. 18, both of Perm, all of U.S.S.R.

[21] Appl. No.: 445,725

[22] PCT Filed: Mar. 29, 1988

[86] PCT No.: PCT/SU88/00075

§ 371 Date: Dec. 4, 1989

§ 102(e) Date: Dec. 4, 1989

[87] PCT Pub. No.: WO89/09099

PCT Pub. Date: Oct. 5, 1989

[51] Int. Cl.[5] ..... B08B 7/04

[52] U.S. Cl. ..... 134/13; 134/10; 134/25.1; 134/42

[58] Field of Search ..... 134/5, 13, 35, 42, 40, 134/10, 12, 25.1, 33

[56] References Cited

U.S. PATENT DOCUMENTS

| | | | |
|---|---|---|---|
| 2,741,596 | 4/1956 | Luark et al. | 134/40 |
| 2,756,168 | 7/1956 | Ruggles | 134/40 |
| 3,689,319 | 9/1972 | Sample et al. | 134/40 |
| 3,734,776 | 5/1973 | Keogh, Jr. | 134/25 R |
| 3,822,213 | 7/1974 | Johnson | 134/40 |
| 3,846,173 | 11/1974 | Ihrig | 134/40 |
| 3,850,721 | 11/1974 | Schubert | 134/5 |
| 3,914,132 | 10/1975 | Sutton | 134/22 R |
| 3,923,539 | 12/1975 | Jorns | 134/2 |
| 4,099,985 | 7/1978 | Garvin et al. | 134/40 |

*Primary Examiner*—Anthony McFarlane

*Attorney, Agent, or Firm*—Burgess, Ryan & Wayne

[57] ABSTRACT

The proposed method resides in that the surface of a workpiece is treated with a molten solvent which at first is crystallized at the surface of the workpiece and then is melted to result in a used solution which is cooled and settled to form two layers, viz., an upper layer containing petroleum products, light mechanical impurities and a quantity of the solvent, and a lower layer containing the solvent, heafy mechanical impurities and a quantity of petroleum products, after which petroleum products are separated from the upper layer, whereas, the crystals of the solvent are melted and added to the lower layer from which the solvent is separated and conveyed for cleaning the workpieces.

An apparatus for carrying out the method comprises a system (12) for regenerating the used solution connected to a system (20) for separating constituents of the upper layer (18), and a system (21) for separating constituents of the lower layer (19).

7 Claims, 3 Drawing Sheets

METHOD OF CLEANING WORKPIECES AND AN APPARATUS FOR CARRYING OUT THE METHOD

FIELD OF THE INVENTION

This invention relates to the art of cleaning workpieces from process impurities, and more particularly to cleaning workpieces from petroleum products and mechanical impurities and an apparatus for carrying out the method.

The invention can find application for cleaning the surface of workpieces from petroleum, vegetable and animal oils, pastes, conservants, lubricating and cooling liquids, and other process contaminants hereinafter referred to as petroleum products and mechanical impurities.

BACKGROUND OF THE INVENTION

The modern production technology involves a range of auxiliary materials including petroleum, vegetable and animal oils, pastes, conservants, lubricating and cooling liquids, etc. They tend to remain at the surface of the workpieces and necessitate cleaning prior to assembly operations or application of protective coatings. Used as cleaning agents are hydrocarbon solvents, chlor- and/or fluorine-containing hydrocarbon solvents, aqueous solutions of electrolytes, surface-active substances, and compounds based thereon. After cleaning these substances carrying impurities are discharged to the outside in the form of industrial sewage, vapours, combusted still residues, and slime. The cost of the thus irrevocably lost chemical substances and the damage to the environment are enormously high.

There is known a method of cleaning workpieces (cf., SU, A, 1,093,732) which includes treating the surface of workpieces with aqueous solutions containing surface-active substances and activating agents, such as ammonium perfulfate, monoethanolamine phosphate, sulfamic acid, oxalic acid, naphthalene sulfonates, and water. The used solutions are regenerated by settling, removing petroleum products floated to the surface of the solution, and filtering the mechanical impurities.

In this method regeneration of the used solution resides only in settling and filtering nonhomogeneous systems. The used solvent contaminated with soluble impurities is not regenerated. Therefore, aqueous solutions, organic solvents and petroleum products are discharged to the outside.

There is also known a method of cleaning the surface of workpieces from petroleum products and mechanical impurities (cf., SU, A, 541,857) residing in that the workpieces to be cleaned are preliminarily heated to 60° C., and washed with a composition containing white spirit, hydroxyethylated alkylphenols or fatty alcohol, water, sodium alkylsulfonate and diesel fuel. Therewith, the workpiece is held at a temperature 50°-60° C. for 10-15 minutes and thereafter washed with an aqueous solution heated to 60° C. and containing 0.1-3.0% tripolyphosphate and 0.1-1% hydroxyethylated alkylphenols. Regeneration of the used solution is carried out by heating it to 80°-90° C., after which the floating petroleum product is separated, and the aqueous solution of the washing composition is repeatedly used for successive cleaning procedures.

However, in the course of cleaning workpieces the solvent tends to partially react with the washed impurities. Petroleum products, fats and solid mechanical impurities periodically released from the process contain the solvent and substances resulting from chemical reaction thereof with impurities, and therefore are subject to concealment.

The aqueous phase saturated with soluble ingredients of the petroleum products is also concealed.

There is further known a method of cleaning the surface of workpieces contaminated with compositions of organic matter (cf;, SU, A,957,672). The method includes treating the workpiece surfaces with polyfluorinated ethers or volatile chlor- and/or fluorine-containing alkanes with admixture of perfluoroalcohols, perfluoroethers, perfluoracids in an amount of 0.02-1 mass percent. Volatile solvents act to spread the dissolved substance at the surface and, while evaporating at a fast rate, remove (disperse) the film of petroleum product from the surface. The amount of the composition consumed is several cu. cm per 100 square inches of surface area. This known method fails to solve the problem of separating the used solutions into initial ingredients for reuse, whereas the consumption of washing compositions is high; the volatile base, viz., fluorohydrocarbon liquids evaporate and break the ozone layer of the atmosphere.

There is known a method of cleaning the surface of workpieces (cf., GB, A, 2,104,104) in which the surface is cleaned with a circulating solvent containing liquid chlor-containing hydrocarbon and a surface-active agent having ingredients thereof so preselected as not to allow them to mix or enter into reaction with process impurities. The used solution is regenerated by evaporating the liquid chlor-containing hydrocarbon. After condensation the surface-active agent is added to the cleaned solvent, and the workpieces are conveyed for repeated cleaning. After evaporation of the solvent the washed off impurities are separated from the surface-active agent to ensure that the latter can be reused. This process is not materialized in the prior art method, whereas the method per se can be used within a narrow range of applications, particularly for cleaning the surface of workpieces after the application of protective coatings thereto possibly accompanied by a tendency of the chlor-containing solvent to decompose in the presence of water and metal chlorides leading to the formation of highly toxic substances.

The known methods can be carried out by a turret type apparatus for cleaning the surface of workpieces made up of standard parts and units depending on the type of the washing solution or demands imposed by the process (cf., Dr; W. Kampschulte, et al., West Germany, Zollingen "Apparatus for cleaning and decreasing using ultrasound and therewithout"). The apparatus comprises a cleaning chamber having a mechanical and an ultrasonic cleaning activation means, a distillation arrangement, a means for separating solid mechanical impurities, and condensers for capturing and condensing vapours of the solvent. This apparatus is characterized by insufficient degree of utilization of the solvent due to the decomposition and reaction of the solvent with the impurities being washed off and with water, and due to the need for concealment of still residues containing substantial quantities of the solvent after the distillation. Losses of solvent in apparatus of this type may amount to between 0.1 and 0.5 kg per 1 $m^2$ of the cleaned workpiece surface.

There is known a method of cleaning workpieces from petroleum products and mechanical impurities carried out by an apparatus disclosed in SU, A, 1,189,515 comprising the steps of cleaning the surface of the workpieces with a circulating flow of solvent, drying the cleaned workpieces, regenerating the used solvent, and separating the washed off impurities. According to this method, the workpieces are heated to a preset temperature, and treated with the circulating solvent. Subsequent to cleaning the workpieces are dried in a vacuum. The dried workpieces are then cooled and withdrawn from the apparatus. Vapours of the solvent resulting from drying are condensed and returned to the cleaning cycle. The used solvent is regenerated by distillation resulting in a distillate and still residues containing a solvent that failed to evaporate, washed off petroleum products, and mechanical impurities. The distillate is returned to the cleaning cycle, whereas the liquid constituents of the still residues are filtered and utilized.

Inherent in this method are high losses of the solvent due to its high volatility, entrainment by the still residue, and the tendency thereof to enter into reaction with the impurities and water.

There is known an apparatus for carrying out the above method (cf., SU, A, 1,189,515) which comprises a conveyer for transporting the workpieces and a series of units including an inlet chamber, neutral chambers, a cleaning chamber with a system for circulating the solvent, a drying chamber connected to a vacuum generating system, a condenser for caputring the solvent vapours, a still, a distillate collector, a petroleum product collector, and a filter for separating mechanical impurities. All the chambers are hermetically sealed by gates.

SUMMARY OF THE INVENTION

It is a major object of the present invention to provide a method of cleaning workpieces from petroleum products and mechanical impurities such as metal filings, shavings and the like and an apparatus for carrying out the method ensuring a higher cleaning efficiency.

Another object is to provide a method of cleaning workpieces from petroleum products and mechanical impurities and an apparatus for carrying out the method capable of reducing the losses of a cleaning medium, such as a solvent.

It is an especially important object of the invention to provide a method of cleaning workpieces from process impurities and an apparatus for carrying out the method capable of substantially reducing the discharge to the environment of impurities washed off the workpieces.

These objects and other attending advantages of the invention are attained by a method of cleaning workpieces to remove petroleum products and mectanical impurities which includes treating the surface of the workpieces with a circulating solvent, drying the cleaned workpieces, regenerating the spent solvent, capturing vapours of the solvent from an air-vapour mixture, and separating the petroleum products and mechanical impurities. According to the invention, the surface of the workpiece is treated with a molten solvent accompanied by crystallization of the solvent on the workpiece surface and subsequent melting of the solvent crystals, the spent solvent is then cooled to a temperature close to the melting point of the solvent, and allowed to settle to form two layers, particularly an upper layer containing petroleum products, light mechanical impurities, and some of the solvent, and a lower layer containing the solvent, heavy mechanical impurities, and some petroleum products, after which the upper layer is remove and cooled to complete crystallization of the solvent therein, the petroleum products are separated therefrom, the crystals of the solvent are melted and added to the lower layer, the solvent is then separated from the lower layer to be recycled for cleaning the workpieces, whereas the light mechanical impurities of the upper layer and heavy mechanical impurities of the lower layer are dried to remove the solvent present therein which is used for cleaning the workpieces.

The present method obtains a higher cleaning efficiency (impurities at the workpiece surface after cleaning amount to between 0.01 and 0.05 mg/cm$^2$), repeatedly regenerates the spent solutions and returns the solvent to the cycle, separates the washed off petroleum products and mechanical impurities, prevents losses of petroleum products, and reduces their discharge to the environment.

Preferably, the solvents are normally solid chlor- and/or fluorine-containing organic substances, chemically inert, and reciprocally insoluble with petroleum products at a temperature below the melting point of the solvent.

The use of such solvents reduces losses thereof by virtue of the absence of chemical interaction with the impurities being removed, low solubility thereof in petroleum products, and low vapour pressure over the solid solvent. In addition, the use of such solvents makes it possible to evacuate the contaminants without changing the chemical composition and properties of the solvents. Thus, very little solvent is lost in the process. For example, losses of the solvent for cleaning 1 m$^2$ of the workpiece surface are less than 4 mg, whereas at least 94% of the petroleum products initially introduced to the cleaning process by the contaminated workpieces are recovered.

Preferably, part of the spent solvent is subjected to distillation, the distillate is removed and used for washing the workpieces, after which the distillate is again returned to the distillation process, whereas the still residue resulting from the distillation and containing petroleum products and a substantial quantity of the solvent is added to the spent solution.

These operations ensure a higher cleaning efficiency and reduce losses of the solvent and petroleum products. The residual dirt after rinsing the surface of the workpieces with the solvent distillate amounts to 0.01–0.001 mg/cm$^2$.

The problem of preventing the discharge of solvent vapcurs to the atmosphere is solved by cooling the air and vapours of chlor- and/or fluorine-containing organic solvent after drying the workpieces to complete crystallization of the solvent, after which the solvent crystals are separated from the air.

Preferably, the solvent crystals separated from the air are melted and used for rinsing the workpieces. This procedure increases the degree of utilization of the solvent.

Preferably, petroleum products are separated from the upper layer of the spent solution by filtering. The filtering operation is more efficient, when the upper layer contains a negligeable quantity of mechanical impurities, whereas the solvent crystals are sufficiently large.

Alternatively, petroleum products can be separated from the upper layer by centrifuging. Centrifuging is preferable for separating petroleum products from finely dispersed crystals and mechanical impurities.

The objects of the invention are also attained by providing an apparatus for carrying out the method comprising a chamber for cleaning workpieces communicating with a system for regenerating the spent solution including a still and distillate collector communicating therewith, a chamber for rinsing the workpieces connected through a pump to the distillate collector, a chamber for drying the workpieces, a means for moving the workpieces through the chambers, a vacuum generation system, and a system for capturing vapours of the solvent.

According to the invention, the system for regenerating the used solution is provided with a cooler of the spent solution connected to a settler for separating the spent solution into two layers, particularly upper and lower layers, the settler being connected to a system for separating the constituents of the upper layer and to a system for separating the constituents of the lower layer, the system for separating the constituents of the upper layer having a crystallizer and means for separating petroleum products arranged in succession, one of the outlets of the means for separating petroleum products being connected to a collector of petroleum products, the other outlet being connected to a collector of the solvent containing a heater and having a lower outlet communicating through a pump with a cooler of the spent solution, whereas the system for separating the constituents of the lower layer includes a pump, a hydrocyclone, and an evaporator having a built-in heater arranged in succession, an upper outlet of the hydrocyclone being connected via the heater to the cleaning chamber, whereas a lower outlet thereof is connected to the evaporator one outlet of which is connected to the settler, and the other to the collector of the solvent.

For attaining a higher degree of cleaning and obtaining a distillate free of petroleum products, and reducing the loss of the solvent and petroleum products it is advisable that the still be provided with three pipes one of which is connected via the pump to the inlet of the cooler. The second pipe being connected to the upper outlet of the hydrocyclone and to the lower outlet of the rinsing chamber, and the third pipe is connected to the collector of the distillate.

Preferably, the system of capturing the vapours of solvent is connected to the drying chamber and provided with a cooler-crystallizer, a cyclone, and a filter arranged in succession and connected to the vacuum generating system to prevent discharge of vapours of the solvent to the atmosphere to minimize the loss of solvent.

Advisably, the lower parts of the cooler-crystallizer, cyclone and filter are heated by the heater, and connected to the collector of distillate, which allows to increase the degree of utilization of the solvent.

Preferably, the means for separating petroleum products comprises a vessel with a filtering element, an arrangement for evacuating crystals of the solvent and light mechanical impurities, and pipes for admitting a non-homogeneous mixture, discharging petroleum products, evacuating the crystals of solvent and light mechanical impurities, and an outlet connected to the vacuum generating system. Such an arrangement ensures virtually complete separation of petroleum products from the crystals of the solvent and mechanical impurities. The petroleum products therefore contain not more than 0.2 mass per cent of the solvent, and can be reused for a range of applications.

Alternatively, the means for separating petroleum products is fashioned as a centrifuge having pipes for admitting a non-homogeneous mixture, evacuating petroleum products, and a pipe for evacuating crystals of the solvent and mechanical impurities.

BRIEF DESCRIPTION OF THE DRAWINGS

The invention will now be described in greater detail with reference to a specific embodiment thereof taken in conjunction with the accompanying drawings, in which.

DETAILED DESCRIPTION OF THE INVENTION

Figure 1:
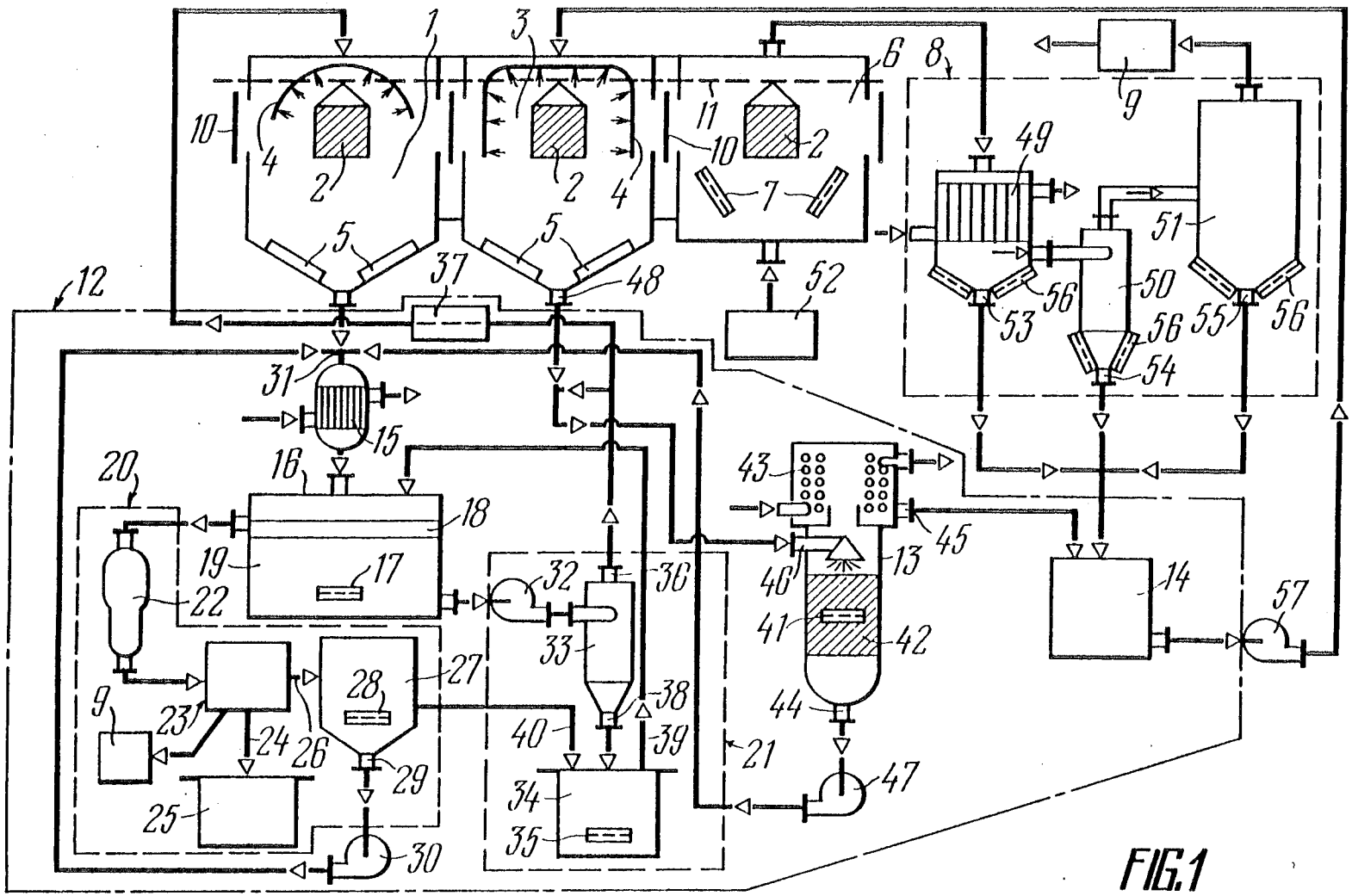
FIG. 1 is a schematic representation of an apparatus for carrying out a method of cleaning workpieces from petroleum products and mechanical impurities.

Workpieces contaminated with petroleum products and having a temperature equal to the interior shop temperature are treated with a circulating molten solvent. At the initial stage, the solvent falling onto the cold surface of the workpiece tends to crystallize, change its volume, and remove solid mechanical impurities stuck to the surface of the workpiece, thereby weakening their bond with the workpiece surface. A subsequent treatment of the workpieces with a molten solvent causes heating of the workpieces, and melting of the solvent, accompanied by removal of petroleum products and mechanical impurities from the workpiece surface. At this stage the residual contamination is within 0.01–0.05 mg/cm$^2$.

The spent solution in the form of a mixture of solvent, petroleum products, light and heavy mechanical impurities is then cooled to a temperature exceeding the melting point of the solvent by 1°–10° C. which results in reduced solubility in the system: solvent-petroleum products, and formation of two layers, viz., an upper layer containing petroleum products, light mechanical impurities and solvent partially dissolved in the petroleum products, and a lower layer containing the solvent, heavy mechanical impurities, and petroleum products partially dissolved in the solvent.

The upper layer is remove and cooled to room temperature, which is accompanied by crystallization of the solvent. The petroleum products are separated from the crystals of the solvent and light mechanical impurities by filtering or centrifuging. The solvent is then melted, separated from light mechanical impurities, and added to the lower layer. Heavy mechanical impurities are separated from the lower layer, whereas the solvent is then used to clean the workpieces; light mechanical impurities of the upper layer and heavy mechanical impurities of the lower layer are joined and dried to separate the solvent, the solvent is evaporated and condensed to be again used for cleaning the workpieces. The mechanical impurities are then withdrawn from the process. Cleaning efficiency is increased through reducing the adhesion of mechanical particles to the surface in the course of crystallization of the solvent at the workpiece surface, loss of solvent is prevented by cooling the upper layer, crystallizing the solvent, and separating petroleum products and solvent, which is returned to the cleaning cycle.

Used as a solvent for cleaning the workpieces are normally solid chlor- and/or fluorine-containing organic substances chemically inert and reciprocably insoluble with petroleum products at a temperature below the melting point of the solvent. These substances are non-inflammable, explosion-resistant and nontoxic to enable, by making use of phase transitions in response to temperature variations, easy separation of petroleum products and mechanical impurities. In addition, low magnitudes of the pressure of vapours above the solid solvent at a room temperature ensure reduced losses of the solvent to the atmosphere.

In order to increase the cleaning efficiency and reduce residual contamination of the surface, the workpieces are rinsed with a distillate of the solvent. For this purpose part of the solvent drawn from the lower layer and free of heavy mechanical impurities is subjected to distillation, whereas the distillate is conveyed for rinsing the workpieces. After this processing stage the residual quantity of impurities is 0.01–0.001 mg/cm$^2$. Subsequent to rinsing, the solution contains the solvent and a negligeable amount of petroleum products dissolved therein. The solution is again conveyed for distillation, whereas the residue formed due to the distillation of the solution and having the form of a mixture of petroleum products (95–70 mass per cent) and solvent (5–30 mass per cent) is added to the spent solution, and regenerated.

In this manner cleaning efficiency is increased, losses of the solvent are reduced due to regeneration of the residue resulting from the distillation process, and distillation is made more efficient.

After rinsing, the workpieces are dried at a temperature above the melting point of the solvent in a vacuum or by hot air.

Air and vapours of chlor- and/or fluorine-containing solvent resulting from drying are cooled to room temperature whereby the solvent tends to crystallize.

Crystals of the solvent are separated from air by filtering, melted, and used for rinsing the workpieces. In this fashion vapours of the solvent are effectively captured and reused during cleaning the workpieces.

The total losses of the solvent when carrying out the method do not exceed 0.004 g per 1 m$^2$ of the workpiece surface being cleaned, and not less than 94% of petroleum products is recovered during the process.

The proposed apparatus for carrying out the method of cleaning the surface of workpieces comprises a chamber 1 for cleaning the workpieces 2, a rinsing chamber 3 having sprayers 4 and sources 5 of ultrasound, a chamber 6 for drying the workpieces 2 having heating elements 7, this chamber 6 being connected to a system 8 for capturing the vapours of the solvent, and a vacuum generating chamber 9. The chambers 1, 3 and 6 are separated from each other and from the outside by gates 10. The apparatus further comprises a means 11 for moving the workpieces in the chambers 1, 3 and 6.

The chamber 1 for cleaning the workpieces 2 is connected to a system 12 for regenerating the spent solution including a still 13 connected to a distillate collector 14, a cooler 15 of the spent solution connected to a settler 16 having a built-in heater 17. The settler 16 serves to separate the used solution into two layers, viz., an upper layer 18 and a lower layer 19, and is connected to a system 20 for separating the constituents (petroleum products, solvent partially dissolved in the petroleum products, and light mechanical impurities) of the upper layer 18, and a system 21 for separating the constituents (petroleum products, solvent partially dissolved in the petroleum products, heavy mechanical impurities) of the lower layer 19. The system 20 for separating the constituents of the upper layer 18 comprises series-connected crystallizer 22 and a means 23 for separating petroleum products, an outlet 24 of the petroleum separating means 23 communicating with a collector 25, whereas an outlet 26 communicates with a collector 27 of petroleum products having a built-in heater 28. A lower outlet 29 of the collector 27 is connected via a pump 30 to an inlet 31 of the cooler 15 of the spent solution. The system 21 for separating the constituents of the lower layer 19 comprises series-connected pump 32, hydrocyclone 33, and an evaporator 34 having a built-in heater 35, an upper outlet 36 of the hydrocyclone 33 being connected via a heater 37 of the solvent to the sprayers 4 of the cleaning chamber 1, whereas a lower outlet 38 is connected to the evaporator 34. An outlet 39 of the evaporator 35 is connected to the settler 16, whereas an outlet 40 is connected to the collector 27 of the solvent.

In the system 12 for regenerating the spent solution the still 13 comprises a heater 41, inserts 42, a cooler 43, and three pipe butts 44, 45, 46; one pipe butt 44 is connected via a pump 47 to the inlet 31 of the cooler 15, pipe 45 is connected to the collector 14 of the distillate, whereas the pipe butt 46 is connected to a lower outlet 48 of the chamber 3 for rinsing the workpieces 2 and to the upper outlet 36 of the hydrocyclone 33.

The drying chamber 6 is connected to the rinsing chamber 3 and to the system 8 for capturing the solvent vapours, which includes components connected in series including a cooler-crystallizer 49, a cyclone 50, and a filter 51. The drying chamber 6 and the system 8 for capturing the solvent vapours are connected to the vacuum generating system 9. It is expedient that the drying chamber 6 and the system 8 for capturing the solvent vapours be connected with a source of heated air 52.

Lower parts 53, 54 and 55 of the cooler-crystallizer 49, cyclone 50, and filter 51 are provided with heaters 56 and connected to the distillate collector 14 in turn connected via a pump 57 to the sprayers 4 of the rinsing chamber 3.

Figure 2:
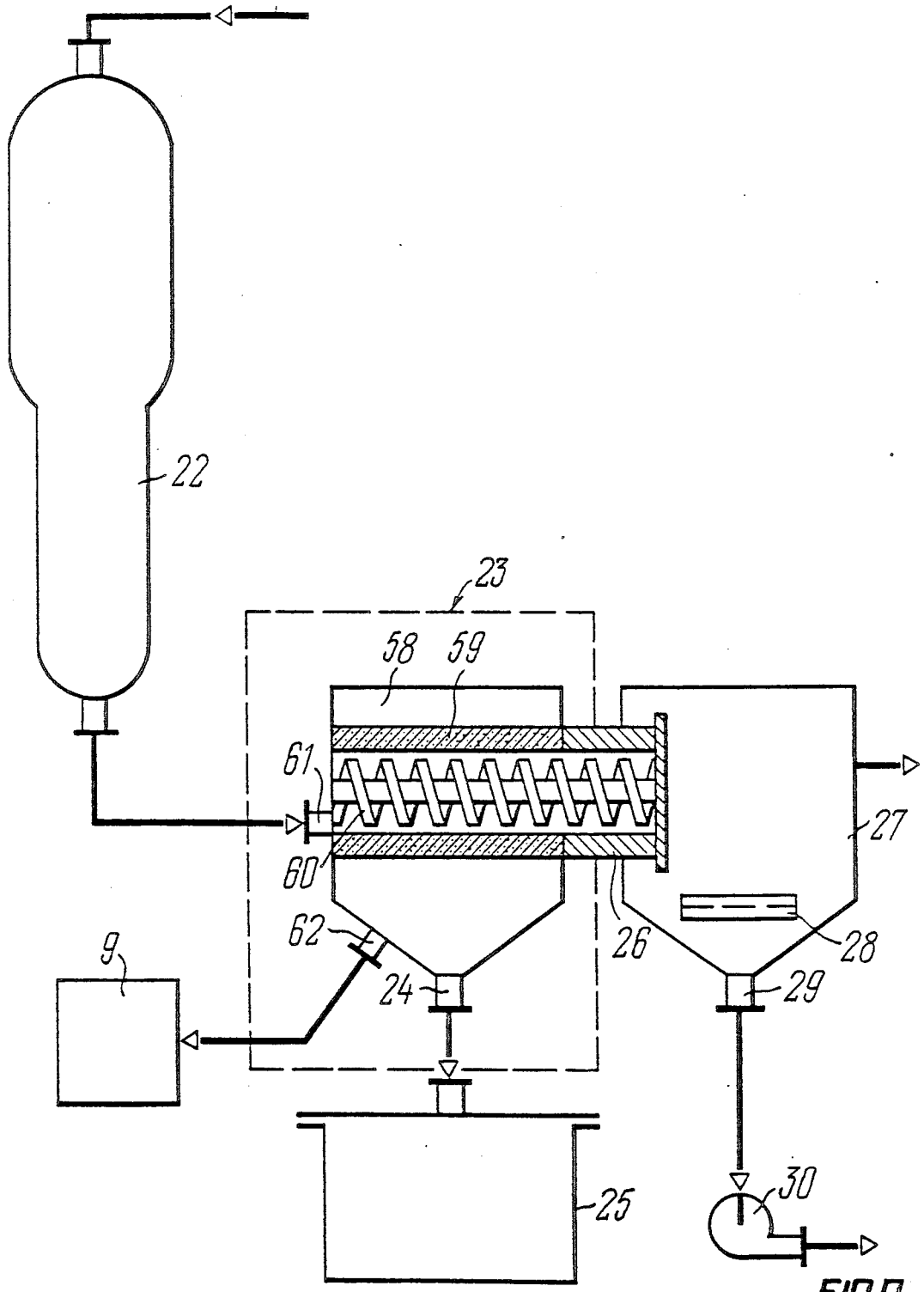
FIG. 2 shows a means for separating petroleum products by filtering.

According to an embodiment shown in FIG. 2, the means 23 for separating petroleum products from the upper layer 18 is constructed as a vessel 58 having a filtering element 59, a mechanism 60 for evacuating the solvent crystals and light mechanical impurities, and inlet pipes 61 for admitting a non-homogeneous mixture, outlet 24 for discharging petroleum products connected to the collector 25 of petroleum products, outlet 26 for discharging the solvent crystals and light mechanical impurities connected to the solvent collector 27, and an outlet 62 connected to the vacuum generating system 9.

Figure 3:
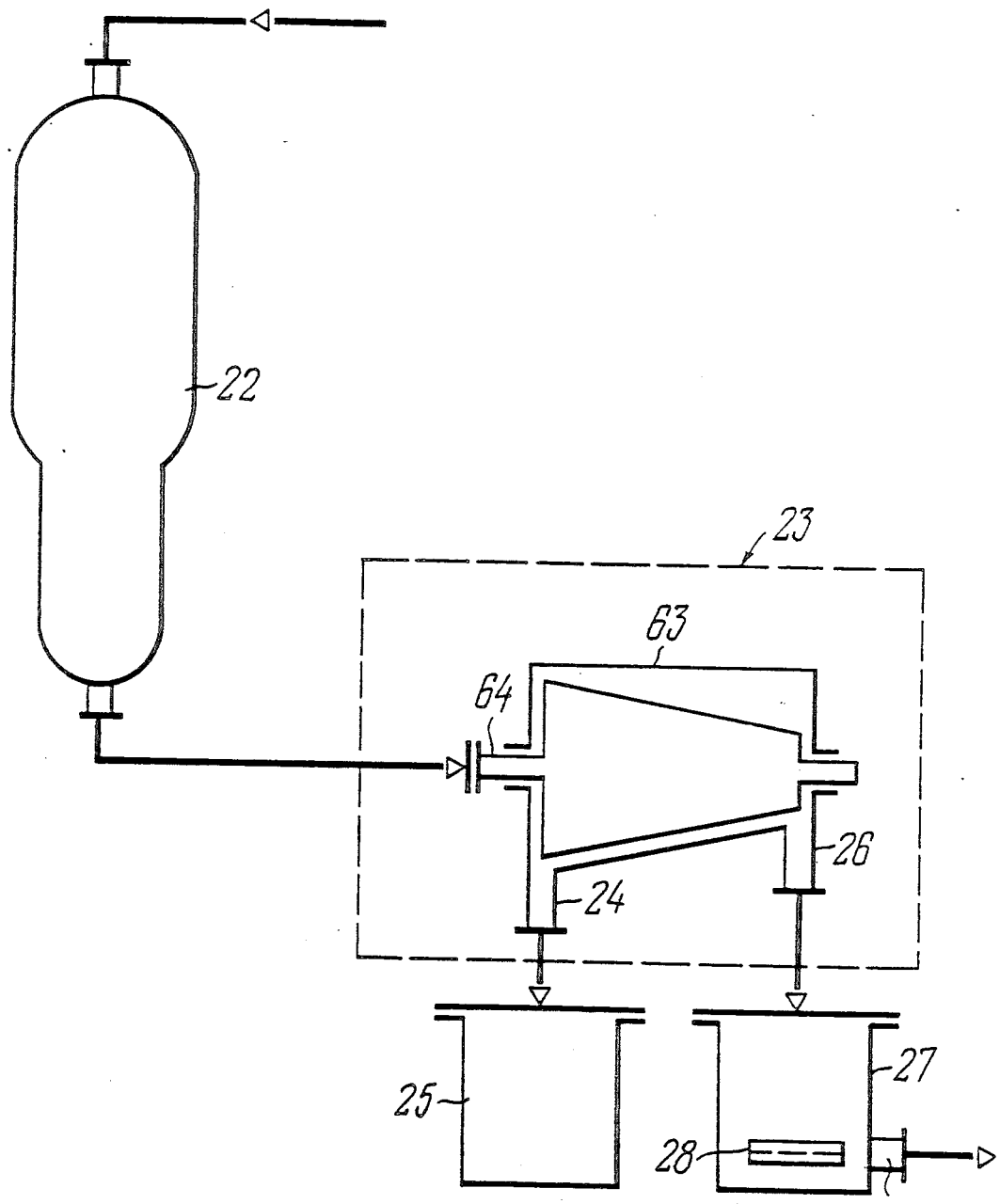
FIG. 3 shows a means for separating petroleum products by centrifuging.

Referring now to FIG. 3, the means 23 for separating petroleum products from the upper layer 18 is constructed as a centrifuge 63 having an inlet pipe 64 for admitting a non-homogeneous mixture connected to the crystallizer 49, and two outlet pipe butts 24, 26 connected to the collector of petroleum products and to the collector 27 of the solvent, respectively.

The proposed apparatus for cleaning workpieces from petroleum products and mechanical impurities operates as follows.

Prior to starting the cleaning operation the apparatus is brought to the working condition. The heaters 7, 17, 37, 41 are energized, the cooling medium is fed to the cooler 15, crystallizer-cooler 49 and cooler 43. Upon attaining the preset temperature conditions the means 11 for moving the workpieces acts to bring the workpieces 2 to the cleaning chamber 1. While being successively moved through the chambers 1, 3 and 6 the workpieces 2 are subjected to cleaning and rinsing with the heated solvent fed from the sprayers 4, and to ultrasonic treatment by the ultrasound sources 5, and to drying by a flow of hot air or in a vacuum.

While drying the surface of the workpieces 2, the air is saturated with vapours of the solvent, and enters the system 8 for capturing the solvent vapours. The chambers 1, 3 and 6 are sealed relative to each other and from the outside by the gates 10.

The spent solution, which is generally a mixture of solvent, petroleum products, light and heavy mechanical impurities, is conveyed from the cleaning chamber 1 to the cooler 15 of the system 12 for regenerating the spent solution, where it is cooled to a temperature close to the melting point of the solvent accompanied by a reduction in the reciprocable solubility of the solvent and petroleum products and formation of an emulsion; the emulsion is then conveyed to the settler 16, where it is settled and separated into two layers, viz., upper layer 18 containing petroleum products, a small quantity of the solvent dissolved therein and light mechanical impurities, and lower layer 19 containing the solvent, a small quantity of petroleum products dissolved therein and heavy mechanical impurities. The upper layer 18 is run off to the system 20 for separating the constituents of the upper layer 18, in which the solvent passes through the crystallizer 22 to be crystallized at a temperature below the melting point thereof; the thus formed nonhomogeneous mixture is fed to the means 23 for separating petroleum products, where the crystals of the solvent and light mechanical impurities are separated from the liquid petroleum products by filtering or by centrifuging. The separated petroleum products are conveyed through the outlet 24 to the collector 25 of petroleum products, whereas the crystals of the solvent and light mechanical impurities enter the collector 27 of solvent where these crystals are melted by the heater 28. The melted solvent is conveyed by the pump 30 through the lower outlet 29 of the collector 27 to the inlet 31 of the cooler 15 of the spent solution.

The lower layer 19 is conveyed by the pump 32 from the settler 16 to the system 21 for separating the constituents of the lower layer 19 for the cyclone 33 to separate the solvent from heavy mechanical impurities, after which the solvent is conveyed through the outlet 36 of the hydrocyclone 33 to the heater 37 to heat the solvent to a preset temperature and force it through the sprayers 4 to the cleaning chamber 1, whereas the heavy mechanical impurities are conveyed through the outlet 38 of the hydrocyclone 33 to the evaporator 34.

Light impurities are also conveyed here from the collector 27 through the outlet 40.

In the evaporator 34 the impurities are heated by the heater 35 to a temperature above the boiling point of the solvent, the solvent is thus evaporated, and its vapours are conveyed through the outlet 39 to the settler 16. The solid residue, heavy and light mechanical impurities are discharged from the evaporator 34 and utilized.

After rinsing the workpieces, the solvent containing a certain amount of petroleum products is conveyed through the lower outlet 48 of the rinsing chamber 3 to the pipe butt 46 of the still 13, and further to the heated insert 42. Part of the solvent, which is free of mechanical impurities, is also conveyed here through the upper outlet 36 of the hydrocyclone 33. The solvent is heated on the insert 42 to boiling and evaporated. Vapours of the solvent are condensed on the cooler 43 to form a distillate. The distillate is conveyed through the pipe 45 to the collector 14 of distillate. The distillate residue containing mostly petroleum products and solvent is conveyed through the lower pipe 44 by the pump 47 to the inlet 31 of the cooler 15 of the system 12 for regenerating the spent solution.

The system 8 for capturing the solvent vapours is connected to the drying chamber 6 to which a hot air is fed from the source of heated air 52 for drying the workpieces. Vapours of the solvent and air after drying the workpieces are caused to pass successively through the cooler-crystallizer 49, cyclone 50 and filter 51 to be cooled, whereby the solvent vapours are crystallized and captured in the cyclone 50 and in the filter 51. For providing a vacuum the system 8 is connected to the vacuum generating system 9.

The crystals of the solvent entrapped in the units 49, 50 and 51 tend to fall into their bottom portions 53, 54 and 55, respectively. As the crystals are accumulated, they are melted by the heaters 56 to flow through the bottom portions 53, 54 and 55 to the distillate collector 14. The pump 57 acts to force the resulting distillate to the sprayers 4 of the rinsing chamber 3.

According to the embodiment shown in FIG. 2, a non-homogeneous mixture containing liquid petroleum products, solid crystals of the solvent and light mechanical impurities is conveyed from the crystallizer 22 through the inlet pipe 61 to the filtering element 59 accommodated inside the vessel 58. The vacuum generating system 9 connected to the pipe 62 produces an underpressure in the vessel 58 to separate the petroleum products.

The petroleum products are conveyed through the pipe 24 to the collector 25, whereas the solid residue composed of solvent crystals and light mechanical impurities is removed from the filtering element 59 by the mechanism 60 through the outlet pipe 26 to the collector 27.

With reference to the embodiment shown in FIG. 3, a non-homogeneous mixture is conveyed from the crystallizer 22 to the pipe 64 of the centrifuge 63, where the liquid petroleum products are separated from the solid crystals of the solvent and mechanical impurities. The thus separated petroleum products flow through the pipe 24 to the collector 25, whereas the mechanical impurities are discharged through the pipe 26 to the collector 27.

In this manner a high quality of cleaning and reduced discharge to the atmosphere are ensured by carrying out the crystallization processes at the surface of the workpieces being cleaned. Another accompanying advantage is more complete regeneration of the solvent and separation of impurities in a closed process cycle.

The advantages of the invention will be more fully understood from a specific example for carrying out the proposed method.

Workpieces having a total surface area of 1 $m^2$ and fouled with industrial grease, metal dust and dirt are placed in the cleaning chamber where they are treated with a jet of molten circulating solvent at a temperature $T \sim 120°$ C. for 5 minutes. At the start of treatment the melt falls on the cold surface of the workpiece to crystallize, change its volume, shift the solids bonded to the workpiece surface, and thereby reduce their adhesion to the surface. A subsequent treatment with the melt leads to heating the workpiece, melting the solvent, and removing the impurities from the surface of the workpieces. Used as the solvent is a fluorine-containing organic substance including eleven atoms of carbon, having a melting point close to 90° C., non-soluble in industrial oil at below its melting point, and chemically inert to the workpieces being cleaned and to the impurities.

The thus cleaned workpiece is transferred to the rinsing chamber to be rinsed with a molten distillate of the fluorine-containing organic substance. After the rinsing the residual surface contamination amounts to 0.001 mg/cm$^2$. The workpiece is then moved to the drying chamber to be dried with hot air at a temperature of 120°-125° C. for 5 minutes.

Vapours of the solvent evaporating from the surface of the workpiece are captured. For this purpose the air-vapour mixture is directed to the cooler-crystallizer where it is cooled to 15°-20° C. The, the vapours are crystallized and partially settled on the bottom of the cooler-crystallizer. The resulting mixture containing crystals of the solvent and air is conveyed to the cyclone to additionally recover crystals from the air, and then to the bag filter, where the solvent crystals are eventually separated from the air. Cloth is normally used at the filtering element of the filter.

Crystals of the solvent captured from the air-vapour mixture in the cooler-crystallizer, cyclone and filter are melted and added to the distillate of the solvent.

After cleaning the workpieces the spent solution is regenerated in the following manner. It is cooled to the melting point to reduce reciprocal solubility in the system "fluorine-containing solvent-industrial oil" to result in an emulsion of industrial oil in the solvent. This emulsion is allowed to settle, whereby two layers are formed, viz., an upper layer containing mostly industrial oil, solvent dissolved therein (2-3 mass percent), and light mechanical impurities, and a lower layer containing predominantly the solvent, industrial oil dissolved therein (0.2-0.3 mass percent), and heavy mechanical impurities.

The upper layer is removed and slowly cooled to 15°-20° C. This is accompanied by a sharp reduction in the solubility of the solvent in oil and formation of a suspension containing large-size crystals of the solvent. The industrial oil is separated from the thus formed suspension by filtering. A filter is used having pore size of the filtering element of 100 mkm. The separated oil is collected in the collector; it contains not more than 0.2 mass percent of the solvent. The crystals of the solvent are removed from the filtering element, melted, and light mechanical impurities are separated therefrom.

The solvent is then added to the spent solution after cleaning the workpiece, whereas the light impurities are directed to the evaporator, and the solvent is separated therefrom. The evaporated solvent is condensed and added to the spent solution, whereas the impurities are evacuated from the evaporator for a subsequent utilization.

Heavy mechanical impurities are separated from the lower layer in the hydrocyclone and conveyed to the evaporator, whereas the solvent is again conveyed for cleaning the workpieces. A quantity of the solvent is distilled to obtain a solvent free of industrial oil, which is then used for rinsing, the workpieces. After rinsing the solvent is again returned for distillation. Still residue containing 95-70 mass percent industrial oil and 5-30 mass percent solvent is added to the used solution and regenerated according to the aforedescribed procedure. A shortage of the solvent entrained with the still residue is replenished by distilling part of the solvent free of mechanical impurities from the lower layer.

The major characteristics of the method set forth in the example are shown in the Table.

In view of the foregoing, the use of the proposed method and apparatus makes it possible to attain a high cleaning efficiency, and prevent the discharge of the solvent and petroleum products being removed to the environment.

INDUSTRIAL APPLICABILITY

The invention can be used with success in mechanical engineering, instrument making, and elsewhere for cleaning workpieces prior to assembling and applying protective coatings.

TABLE

Characteristics of the proposed method with respect to cleaning 1 m$^2$ of workpieces surface

| No. = 1 | Solvent, T - melting point 2 | Initial contamination of the workpiece, mg/cm$^2$ 3 | Cleaning temperature, $T_2$ °C. 4 | Contamination of the workpiece after cleaning and drying, mg/cm$^2$ 5 |
|---|---|---|---|---|
| 1 | Fluorine-containing organic solvent including 11 carbon atoms in the molecule, T = 90° C. | 6.1335 | 110 | 0.0125 |
| 2. | Chlor-containing organic solvent including 9 carbon atoms in the molecule, T = 46° C. | 6.7281 | 60 | 0.0220 |
| 3. | Chlor-containing organic solvent including 6 carbon atoms in the molecule, T = 110° C. | 5.1479 | 120 | 0.0374 |

| 1 | Drying temperature, $T_3$ °C. 6 | Temperature of rinsing with the distillate, $T_4$ °C. 7 | Contamination of the workpiece after rinsing, mg/cm$^2$ 8 | Total loss of the solvent, g/m$^2$ 9 | Total loss of petroleum products, mass per cent 10 |
|---|---|---|---|---|---|
| 1. | 120 | 110 | 0.0021 | 3 | 4 |
| 2. | 90 | 60 | 0.0024 | 5 | 5.4 |
| 3. | 140 | 120 | 0.0032 | 4 | 6 |

We claim:

1. A method of cleaning workpieces to remove petroleum products and solid impurities by treating the surface of said workpieces with a circulating solvent, drying the cleaned workpieces, regenerating a spent solvent and recovering solvent vapors, said method comprising treating the surface of said workpieces with a melt of a solvent accompanied by crystallization of said solvent on the surface of said workpieces, subsequently melting said solvent, cooling said spent solvent to a temperature close to the melting point of the solvent to allow it to settle into two layers; an upper layer containing petroleum products, light solid impurities and a quantity of the solvent, and a lower layer containing the solvent, heavy solid impurities and a quantity of petroleum product; cooling the upper layer to complete crystallization of the solvent therein, separating petroleum products therefrom, melting crystals of the solvent and adding them to the lower layer from which the solvent is separated and recycled for cleaning the workpieces, and drying the light solid impurities of the upper layer and heavy solid impurities of the lower layer to separate solvent, and recycling the solvent for cleaning workpieces.

2. A method as claimed in claim 1, wherein normally solid chlor- and/or fluorine-containing organic substances chemically inert and mutually insoluble with petroleum products at a temperature below the melting point of the solvent are used as the solvent.

3. A method as claimed in claim 1, wherein part of the spent solvent is distilled, the distillate is conveyed for rinsing the workpieces, and subsequent to rinsing the distillate is again conveyed for distillation, whereas a still residue resulting from distillation is added to the spent solvent.

4. A method as claimed in claim 2, wherein air and vapours of the chlor- and/or fluorine-containing organic solvent after drying the workpieces are cooled to complete crystallization of the solvent, and the solvent crystals are separated from the air.

5. A method as claimed in claim 4, wherein crystals of the solvent separated from the air are melted and used for rinsing the workpieces.

6. A method as claimed in claim 1, wherein petroleum products are separated from the upper layer by filtering.

7. A method as claimed in claim 1, wherein petroleum products are separated from the upper layer by centrifuging.

* * * * *